US007003461B2

(12) United States Patent
Tavares

(10) Patent No.: US 7,003,461 B2
(45) Date of Patent: Feb. 21, 2006

(54) METHOD AND APPARATUS FOR AN ADAPTIVE CODEBOOK SEARCH IN A SPEECH PROCESSING SYSTEM

(75) Inventor: Clifford Tavares, San Jose, CA (US)

(73) Assignee: Renesas Technology Corporation, Tokyo (JP)

( * ) Notice: Subject to any disclaimer, the term of this patent is extended or adjusted under 35 U.S.C. 154(b) by 514 days.

(21) Appl. No.: 10/192,059

(22) Filed: Jul. 9, 2002

(65) Prior Publication Data

US 2004/0010406 A1 Jan. 15, 2004

(51) Int. Cl.
*G10L 19/12* (2006.01)

(52) U.S. Cl. ..... 704/262; 704/263; 704/266

(58) Field of Classification Search ..... 704/262, 704/263, 266, 270, 275, 500, 219, 220, 222, 704/230, 207

See application file for complete search history.

(56) References Cited

U.S. PATENT DOCUMENTS

| | | | | |
|---|---|---|---|---|
| 5,031,037 | A | 7/1991 | Israelsen | |
| 5,327,520 | A * | 7/1994 | Chen | 704/219 |
| 5,530,661 | A | 6/1996 | Garbe et al. | |
| 5,717,825 | A * | 2/1998 | Lamblin | 704/223 |
| 5,892,960 | A | 4/1999 | Seide | |
| 6,161,086 | A * | 12/2000 | Mukherjee et al. | 704/207 |
| 6,314,393 | B1 | 11/2001 | Zheng et al. | |
| 6,766,289 | B1 * | 7/2004 | Kandhadai et al. | 704/207 |

FOREIGN PATENT DOCUMENTS

| | | |
|---|---|---|
| WO | WO 97/33236 | 9/1997 |

OTHER PUBLICATIONS

Using MMX™ Instruction to Implement the G.728 Codebook Search.
Parallel Local Operator Engine and Fast P300, IBM Technical Disclosure Bulletin, Jan. 1990.
Palmer, Robert et al., Annual Research Summary, Section 5 Computer Engineering, Jul. 1, 1994-Jun. 30, 1995, 1 page.
Talla, Deepu, Evaluating VLIW and SIMD Architectures for DSP and Multimedia Applications, Department of Electrical and Computer Engineering, The University of Texas at Austin.
Clark, Peter, ISSC: Multiprocessing Architectures Unveiled, EE Times, Feb. 8, 2000.
Gentile, Antonio et al., Real-Time VQ-Based Image Compression on the Simpil Low Memory SIMD Architecture, Feb. 5, 1997, Georgia Tech School of Electrical and Computer Engineering.

* cited by examiner

*Primary Examiner*—Susan McFadden
(74) *Attorney, Agent, or Firm*—Townsend and Townsend and Crew LLP

(57) ABSTRACT

An adaptive codebook search (ACS) algorithm is based on a set of matrix operations suitable for data processing engines supporting a single instruction multiple data (SIMD) architecture. The result is a reduction in memory access and increased parallelism to produce an overall improvement in the computational efficiency of ACS processing.

21 Claims, 9 Drawing Sheets

$$R\begin{bmatrix} \overbrace{\begin{matrix} 0 & 0 & 0 & R_0 \\ 0 & 0 & R_0 & R_1 \\ 0 & R_0 & R_1 & R_2 \end{matrix}}^{212a} \\ \begin{matrix} R_0 & R_1 & R_2 & R_3 \end{matrix} \end{bmatrix} * I \begin{bmatrix} I_3 \\ I_2 \\ I_1 \\ I_0 \end{bmatrix} = \begin{bmatrix} 0 & 0 & 0 & R_0 I_0 \\ 0 & 0 & R_0 I_1 & R_1 I_0 \\ 0 & R_0 I_2 & R_1 I_1 & R_2 I_0 \\ R_0 I_3 & R_1 I_2 & R_2 I_1 & R_3 I_0 \end{bmatrix} = F \begin{bmatrix} F_0 \\ F_1 \\ F_2 \\ F_3 \end{bmatrix}$$

FIG. 2A $$R\begin{bmatrix} \overbrace{\begin{matrix} 0 & 0 & 0 & R_4 \\ 0 & 0 & R_4 & R_5 \\ 0 & R_4 & R_5 & R_6 \end{matrix}}^{212b} \\ \begin{matrix} R_4 & R_5 & R_6 & R_7 \end{matrix} \end{bmatrix} * I \overbrace{\begin{bmatrix} I_3 \\ I_2 \\ I_1 \\ I_0 \end{bmatrix}}^{212c} = \begin{bmatrix} 0 & 0 & 0 & R_4 I_0 \\ 0 & 0 & R_4 I_1 & R_5 I_0 \\ 0 & R_4 I_2 & R_5 I_1 & R_6 I_0 \\ R_4 I_3 & R_5 I_2 & R_6 I_1 & R_7 I_0 \end{bmatrix} = F' \begin{bmatrix} F_4 \\ F_5 \\ F_6 \\ F_7 \end{bmatrix}$$

FIG. 2B $$I\begin{bmatrix} \overbrace{\begin{matrix} I_1 & I_2 & I_3 & I_4 \\ I_2 & I_3 & I_4 & I_5 \\ I_3 & I_4 & I_5 & I_6 \end{matrix}}^{212c} \\ \begin{matrix} I_4 & I_5 & I_6 & I_7 \end{matrix} \end{bmatrix} * R \begin{bmatrix} R_3 \\ R_2 \\ R_1 \\ R_0 \end{bmatrix} = \begin{bmatrix} I_1 R_3 & I_2 R_2 & I_3 R_1 & I_4 R_0 \\ I_2 R_3 & I_3 R_2 & I_4 R_1 & I_5 R_0 \\ I_3 R_3 & I_4 R_2 & I_5 R_1 & I_6 R_0 \\ I_4 R_3 & I_5 R_2 & I_6 R_1 & I_7 R_0 \end{bmatrix} = F'' \begin{bmatrix} F_4 \\ F_5 \\ F_6 \\ F_7 \end{bmatrix}$$

FIG. 2C $$F' \begin{bmatrix} F_4 \\ F_5 \\ F_6 \\ F_7 \end{bmatrix} + F'' \begin{bmatrix} F_4 \\ F_5 \\ F_6 \\ F_7 \end{bmatrix} = F \begin{bmatrix} F_4 \\ F_5 \\ F_6 \\ F_7 \end{bmatrix}$$

FIG. 2D $$R\begin{bmatrix} \overbrace{\begin{matrix} 0 & 0 & 0 & R_n \\ 0 & 0 & R_n & R_{n+1} \\ 0 & R_n & R_{n+1} & R_{n+2} \end{matrix}}^{312a} \\ \begin{matrix} R_n & R_{n+1} & R_{n+2} & R_{n+3} \end{matrix} \end{bmatrix} * I \overbrace{\begin{bmatrix} I_3 \\ I_2 \\ I_1 \\ I_0 \end{bmatrix}}^{312b} = F' \begin{bmatrix} F_n \\ F_{n+1} \\ F_{n+2} \\ F_{n+3} \end{bmatrix}$$

FIG. 3A $$\sum_{\substack{m=n+3 \\ I=0}}^{\substack{(m-6)>0,\ step-4 \\ I,\ step+4}} I \begin{bmatrix} \overbrace{\begin{matrix} I_{m-6} & I_{m-5} & I_{m-4} & I_{m-3} \\ I_{m-5} & I_{m-4} & I_{m-3} & I_{m-2} \\ I_{m-4} & I_{m-3} & I_{m-2} & I_{m-1} \end{matrix}}^{312c} \\ \begin{matrix} I_{m-3} & I_{m-2} & I_{m-1} & I_m \end{matrix} \end{bmatrix} * R \begin{bmatrix} R_{I+3} \\ R_{I+2} \\ R_{I+1} \\ R_I \end{bmatrix} = F'' \begin{bmatrix} F_n \\ F_{n+1} \\ F_{n+2} \\ F_{n+3} \end{bmatrix}$$

FIG. 3B $$\begin{bmatrix} 0 & \cdots & \cdots & 0 & R_{2^s} \\ \vdots & & & R_{2^s} & R_{2^s+1} \\ \vdots & & \iddots & & \vdots \\ 0 & R_{2^s} & & & \vdots \\ R_{2^s} & R_{2^s+1} & \cdots & \cdots & R_{(2^s+1)} \end{bmatrix} \times \begin{bmatrix} I_{2^s-1} \\ \vdots \\ \vdots \\ \vdots \\ I_0 \end{bmatrix}$$

$$\begin{bmatrix} I_1 & I_2 & \cdots & I_{2^s-1} & I_{2^s} \\ I_2 & I_3 & & I_{2^s} & I_{2^s+1} \\ \vdots & & \iddots & & \vdots \\ I_{2^s-1} & I_{2^s} & & & \vdots \\ I_{2^s} & I_{2^s+1} & \cdots & \cdots & I_{2^s+(2^s+1)} \end{bmatrix} \times \begin{bmatrix} R_{2^s-1} \\ \vdots \\ \vdots \\ \vdots \\ R_0 \end{bmatrix}$$

$$s > 2$$

*FIG. 5A*

$$\begin{bmatrix} 0 & \cdots & \cdots & 0 & R_n \\ \vdots & & & R_n & R_{n+1} \\ \vdots & & \iddots & & \vdots \\ 0 & R_n & & & \vdots \\ R_n & R_{n+1} & \cdots & \cdots & R_{n+(2^s-1)} \end{bmatrix} \times \begin{bmatrix} I_{2^s-1} \\ \vdots \\ \vdots \\ \vdots \\ I_0 \end{bmatrix}$$

$n = 2^s, 2*2^s, 3*2^s, 4*2^s$, etc.

$$\begin{bmatrix} I_{(m-(2^s-1))-(2^s-1)} & \cdots & I_{(m-(2^s-1))} \\ \vdots & & \vdots \\ \vdots & & \vdots \\ I_{(m-(2^s-1))} & \cdots & I_m \end{bmatrix} \times \begin{bmatrix} R_{l+(2^s-1)} \\ \vdots \\ \vdots \\ R_l \end{bmatrix}$$

$m = n+(2^s-1)$, step $-2^s$
$1=0$, step $+2^s$

*FIG. 5B*

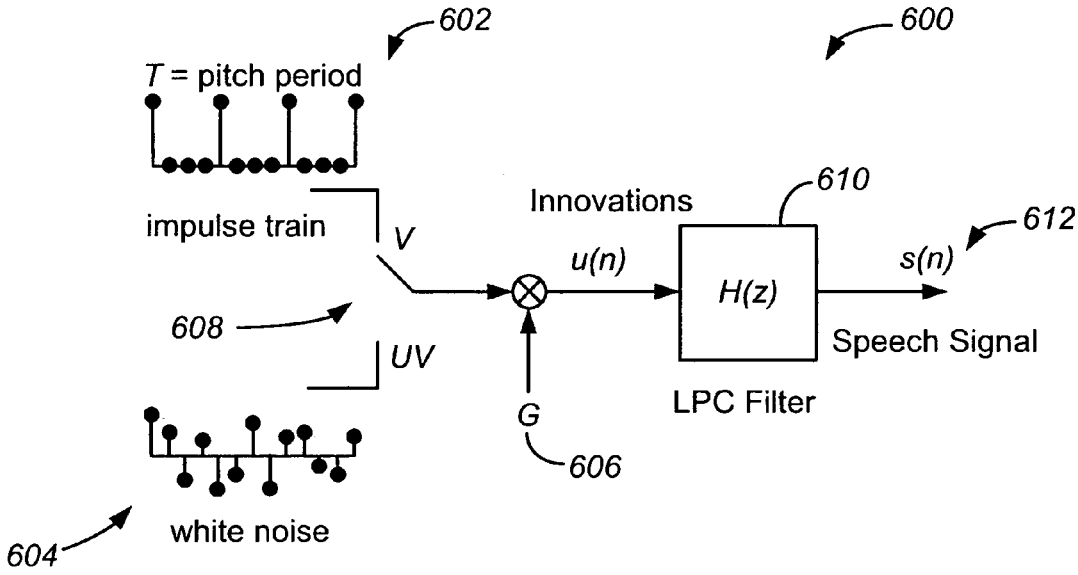
| Mathematical model | Physical model |
|---|---|
| H(z) (LPC Filter) | Vocal Tract |
| U(n) (Innovations) | Air |
| V (voiced) | Vocal Cord Vibration |
| T (pitch period) | Vocal Cord Vibration Period |
| UV (unvoiced) | Fricatives and Plosives |
| G (gain) | Air Volume |
*FIG. 6* *(Prior Art)*

METHOD AND APPARATUS FOR AN ADAPTIVE CODEBOOK SEARCH IN A SPEECH PROCESSING SYSTEM

BACKGROUND OF THE INVENTION

The present invention relates to speech processing in general, and more particularly to a speech encoding method and system based on code excited linear prediction (CELP).

FIG. 6 shows the conventional model for human speech production. The vocal cords are modeled by an impulse generator that produces an impulse train 602. A noise generator produces white noise 604 which models the unvoiced excitation component of speech. In practice, all sounds have a mixed excitation, which means that the excitation consists of voiced and unvoiced portions. This mixing is represented by a switch 608 for selecting between voiced and unvoiced excitation. An LPC filter 610 models the vocal tract through which the speech is formed as the air is forced through it by the vocal chords. The LPC filter is a recursive digital filter; its resonance behavior (frequency response) being defined by a set of filter coefficients. The computation of the coefficients is based on a mathematical optimization procedure referred to as linear prediction coding, hence "LPC filter."

Code-excited linear prediction (CELP) is a speech coding technique commonly used for producing high quality synthesized speech at low bit rates, i.e., 4.8 to 9.6 kilobits-per-second (kbps). This class of speech coding, also known as vector-excited linear prediction, utilizes a codebook of excitation vectors to excite the LPC filter 610 in a feedback loop to determine the best coefficients for modeling a sample of speech. A difficulty of the CELP speech coding technique lies in the extremely high computationally intense activity of performing an exhaustive search of all the excitation code vectors in the codebook. The codebook search consumes roughly 60% of the total processing time of a speech codec (compression encoder-decoder).

The ability to reduce the computation complexity without sacrificing voice quality is important in the digital communications environment. Thus, a need exists for improved CELP processing.

SUMMARY OF THE INVENTION

A method and system for speech synthesis includes an adaptive codebook search (ACS) process based on a set of matrix operations suited for data processing engines which support one or more SIMD (single instruction multiple data) instructions. A set of matrix operations were determined which recast the conventional standard algorithm for ACS processing so that a SIMD implementation achieves not only improved computational efficiency, but also reduces the number of memory accesses to realize improvements in CPU (central processing unit) performance.

BRIEF DESCRIPTION OF THE DRAWINGS

FIGS. 2A–2D illustrate the matrix operations in accordance with the invention;

FIGS. 3A–3C illustrate generalized matrix operations according to the teachings of the invention;

FIGS. 5A and 5B illustrate a generalization of the matrix operations to include SIMD processing engines having n-way parallelism; and FIG. 6 illustrates a conventional model of the human vocal tract.

DESCRIPTION OF THE SPECIFIC EMBODIMENTS

Figure 1:
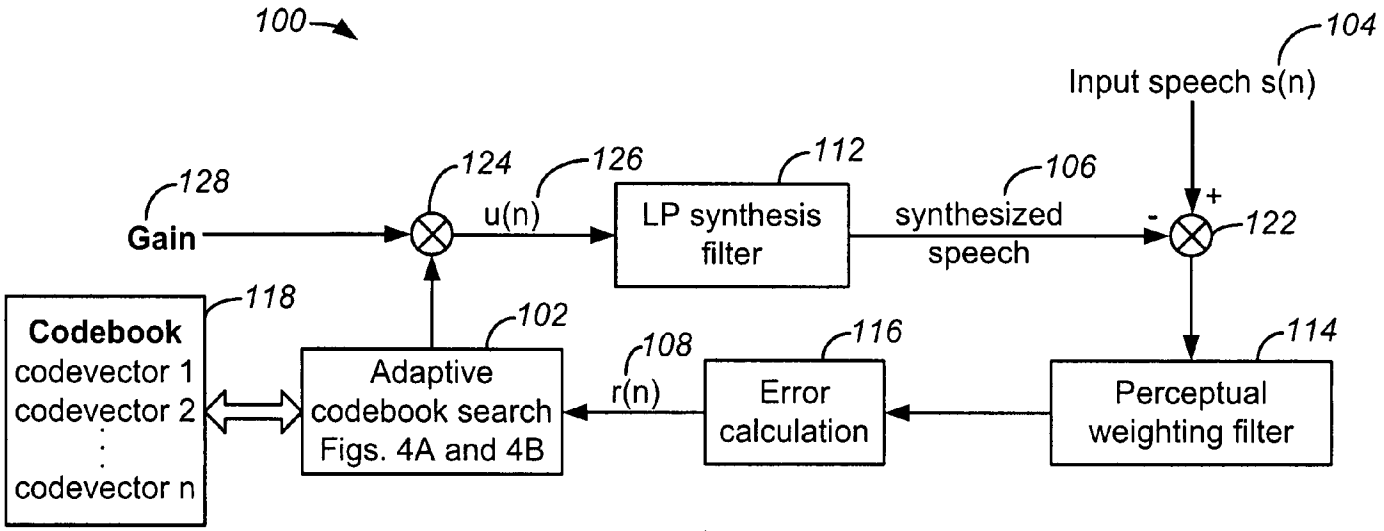
FIG. 1 shows a high level system block diagram of a speech synthesis system in accordance with an embodiment of the invention.

FIG. 1 shows a high level block diagram of a speech coder 100, embodying aspects of the present invention. The block diagram represents the functional aspects of a speech coder in accordance with a particular implementation standard, namely, G.723. It can be appreciated that other standards, such as G.728, G.729, implement the same function, and even special purpose non-standard codecs can be built to implement similar functionality. An excitation signal 126 is fed as input to a synthesis filter 112. The excitation signal is chosen from a codebook of excitation sequences 118 commonly referred to as excitation code vectors. For each frame of speech, a codebook search process 102 selects an excitation signal and applies it the synthesis filter 112 to generate a synthesized speech signal 106. The synthesized speech is compared 122 to the original input speech signal 104 to produce an error signal. The error signal is then weighted by passing it through a weighting filter 114 having a response based on human auditory perception. The weighted error signal is then processed by the error calculation block 116 (e.g., per G.723) to produce a residual excitation signal 108 (also referred to as a target vector signal).

The optimum excitation signal is determined in the codebook search process 102 by selecting the code vector which produces the weighted error signal representing the minimum energy for the current frame; i.e., the search through a codebook of candidate excitation vectors is performed on a frame-by-frame basis. Typically, the selection criterion is the sum of the squared differences between the original and the synthesized speech samples resulting from the excitation information for each speech frame, called the mean squared error (MSE).

Figure 1A:
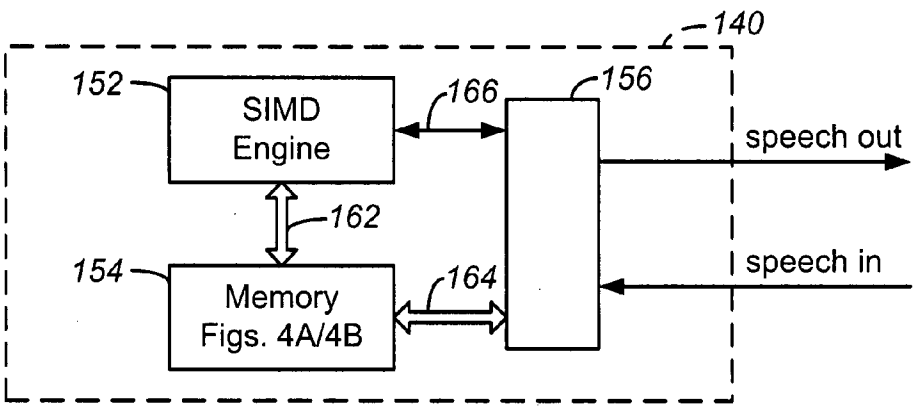
FIG. 1A shows a generalized block diagram of a typical hardware configuration of a speech synthesizer, incorporating aspects of the invention.

Referring to the general architectural diagram of a speech synthesis system 140 of FIG. 1A, it can be appreciated that numerous specific implementations of the components shown in FIG. 1 are possible. A common implementation of the processing components (e.g., filter 112, search process 102, and so on) is on a digital signal processor (DSP), executing appropriately written code for the DSP. The processing components can be implemented on a PC (personal computer) platform executing one or more software components. Depending on performance requirements, the components might be implemented using multiple hardware processing units.

As shown in FIG. 1A, the processing component 152 includes a single instruction multiple data (SIMD) architecture which implements a SIMD instruction set. Generally, any SIMD engine can be used as the processing component and is not limited to conventional processors. Thus, for example, a custom ASIC that supports at least a SIMD multiply and accumulate instruction can be used.

The speech coder can utilize various storage technologies. A typical storage (memory) component 154 of the system can include conventional RAM (random access memory) and hard disk storage. The program code that is executed can reside wholly in a RAM component, or portions may be stored in RAM and/or a cache memory and other portions on a hard drive as is commonly done in modem operating system (OS) environments. The program code can be stored in firmware. The codebook might be stored in some form of non-volatile memory. Other implementations can include ASIC-microcontroller combinations, and so on.

A signal converter 156 is typically included to convert the analog speech-in signal to a suitable digital format, and conversely an analog speech-out signal can be produced by converting the digital data. The SIMD-based processor 152 can include one or more control signals 166 which are communicated to operate the signal converter. Data channel 162 and 164 can be provided to provide data paths among the various components.

The speech synthesis system 140 can be any system that utilizes speech synthesis or otherwise benefits from speech synthesis. Examples include mobile devices supporting voice communication such as video conference systems, audio recorders, dictaphones, voice mail boxes, order processing systems, security, and intercom systems. These devices typically require real time processing capability, have limits on power consumption, and have limited processing resources. Further, most current day fixed point application processors have SIMD extensions. The present invention uses the SIMD architecture to reduce the computational load on the data processing component 152. Hence devices can operate in a lower power mode. Mail boxes and dictaphones having limited processing resources use uncompressed voice transactions. These devices can be replaced by the voice codecs using compression technology, thereby increasing the efficiency of storage. Existing mobile phones and conference systems make use of CELP based voice codecs. The present invention frees up the processor to perform additional functions, or simply to save power. Most existing analog voice applications such as intercom/security systems will be eventually replaced by digital systems with content compression for better resource usage, and thus would be well suited for use with the present invention.

The calculation which takes place in the codebook search process 102 involves computing the convolution of each excitation frame stored in the codebook with the perceptual weighted impulse response. Calculations are performed by using vector and matrix operations of the excitation frame and the perceptual weighting impulse response. The calculation includes performing a particular set of matrix computations in accordance with the invention to compute a correlation vector representing the correlation between the target vector signal 108 and an impulse response.

As mentioned above, adaptive codebook search involves searching for a codebook entry that minimizes the mean square error between the input speech signal and the synthesized speech. It can be shown (per the G.723.1 ITU specification) that the computation of MSE can be reduced to an equation whose "maximum" represents the best codebook entry to be selected:

$$\mathrm{Max}Val = \left(\frac{(d^T v_i)^2}{v_i^T \phi v_i}\right),$$

where i is an index into codebook, $v_i$ is the excitation vector at index i, $\phi = H^T H$, $d = H^T R$, R is the target vector signal, and H is the impulse response of the synthesis filter 112 (FIG. 1).

The quantity d represents the correlation between the target vector signal r and the impulse response H. The quantity d is defined by:

$$d = \sum_{n=j}^{FrmSz} R[n] \cdot H[n-j],$$

where FrmSz is the frame size, e.g., 59 frames, and $0 \leqq j \leqq FrmSz$.

The quantity $\phi$ represents the covariance matrix of the impulse response:

$$\phi = \sum_{n=j}^{FrmSz} H[n-i] \cdot H[n-j].$$

For each excitation vector $v_i$, a metric $\mathrm{MaxVal}_i$ is computed. Each excitation vector therefore has an associated $\mathrm{MaxVal}_i$. A minimum value of the metric is determined and the vector associated with that metric is deemed to be the entry that minimizes the mean square error.

FIGS. 2A–2D illustrate a procedure for computing the correlation quantity d according to the teachings of the present invention. First, a brief discussion of a conventional implementation for computing the correlation quantity is presented.

The equation for d for a speech codec (coder/decoder) per the ITU (International Telecommunication Union) reference 'C' implementation is expressed as:

$$\sum_{i=0}^{FrmSz} \sum_{j=0}^{i} (RzBf[pitch-1+j] \times ImpRes[i-j]),$$

where RzBf is the residual excitation buffer (i.e. the target vector signal),

ImpRes is the impulse response buffer, and pitch is a constant.

A typical scalar implementation of this expression is shown by the following C-language code fragment:

```
for ( i = 0 ; i < SUB_FRAME_LENGTH ; i ++ )
{
        Acc0 = (Word32) 0 ;
        for (j = 0 ; j <= 1 ; j ++ )
        {
        Acc0 = saturate( Acc0 + RezBuf[CL_PITCH_ORD-1+j]* ImpResp[i-j] ) ;
    }
    FltBuf [CL_PITCH_ORD-1][i] = round( Acc0 );
        }
```

The 'saturate( )' function or some equivalent is commonly used to prevent overflow.

A line-by-line statistical profiling of a conventional adaptive codebook search algorithm indicates that the foregoing implementation for computing the correlation quantity d consumes about one third of the total processing time in a speech codec.

It was discovered that a decomposition of the expression:

$$\sum_{i=0}^{FrmSz}\sum_{j=0}^{i}(RzBf[pitch-1+j]\times ImpRes[i-j]),$$

can be produced that reduces the computational load for computing the correlation quantity. More specifically, it was discovered that a certain combination of matrix operations can be obtained which is readily implemented using a SIMD instruction set. Moreover, the instructions can be coded in a way that reduces the number of accesses between main memory and internal registers in a processing unit.

Referring now to FIGS. 2A–2D, a set of matrix operations is shown for an iteration of the above nested summation operation. Here, the following notational conventions will be adopted:

- I[ ] is the vector ImpRes[ ], where a vector element is referenced as $I_i$,
- R[ ] is the vector RzBf[ ], where a vector element is referenced as $R_i$, and
- F[ ] is an output vector FltBuf[ ] to store the result of the operation and thus is representative of the correlation quantity d, where a vector element is referenced as $F_i$.

In accordance with the invention, the first four elements of F[ ] ($F_0$–$F_3$) can be expressed by the matrix operation shown in FIG. 2A. The next four elements F[ ] ($F_4$–$F_7$) can be expressed by the matrix operations shown in FIGS. 2B and 2C. A constituent component of elements $F_4$–$F_7$ is intermediate vector F'[ ] which is determined by the operation shown in FIG. 2B. This matrix operation represents the computation which occurs at the end of the series RzBf [pitch−1+j]×ImpRes[i−j].

Another constituent component of elements $F_4$–$F_7$ is intermediate vector F"[ ] which is determined by the operation shown in FIG. 2C. This matrix operation represents the computations which occur in the middle of the series RzBf [pitch−1+j]×ImpRes[i−j].

As can be seen in FIG. 2D, the elements $F_4$–$F_7$ of F[ ] can be determined as the sum of F'[ ] and F"[ ].

The matrix operations shown in FIGS. 2B and 2C lead to a generalized set of computational operations to perform the entire computation of the correlation quantity d. This can be seen with reference to the generalized matrix operations shown in FIGS. 3A–3C.

Every four elements in F[ ] (e.g., $F_4$–$F_7$, $F_8$–$F_{11}$, $F_{12}$–$F_{15}$, etc.) can be determined by computing every four elements of its constituent intermediate vectors, F' and F".

FIG. 3A represents the generalized form for the matrix operation shown in FIG. 2B for computing the intermediate vector F' for the entire vector F[ ], four elements at a time. The generalized form includes an index n, which is incremented by four for each set of four elements in the intermediate vector F'.

FIG. 3B represents the generalized form for matrix operation shown in FIG. 2C for computing the intermediate vector F" for the entire vector F[ ], four elements at a time. This operation involves a summation operation because it occurs in the middle of the series RzBf[pitch−1+j]×ImpRes[i−j]. The notation in the summation:

$$\sum_{\substack{m=n+3\\ l=0}}^{\substack{(m-6)>0\\ m,step\ -4\\ l,step\ +4}}$$

indicates that the index l begins at zero and increments by four. The index m begins at (n+3) and decrements by four. The summation stops when $(m-6)\leqq 0$.

Figure 3C:
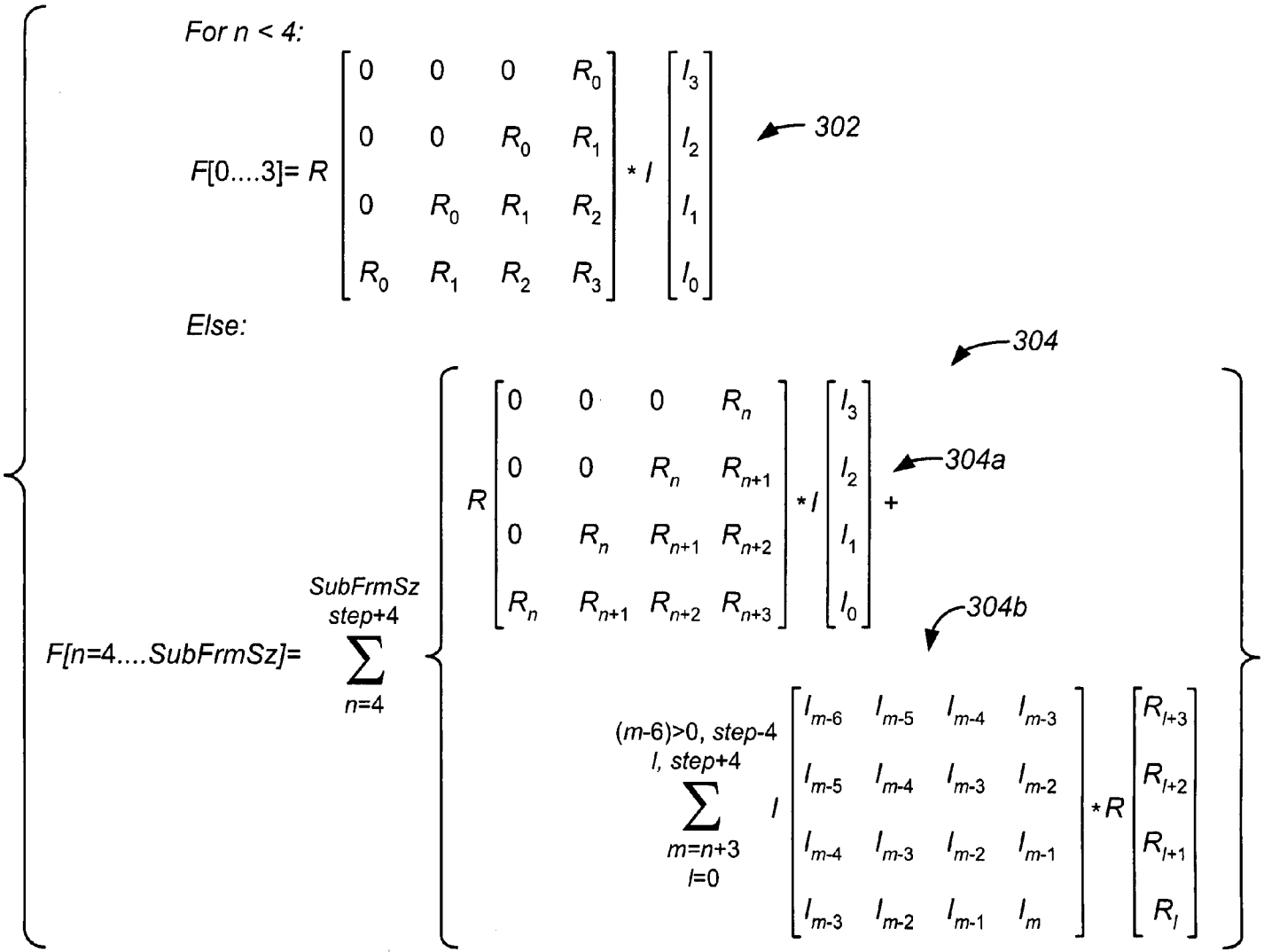

FIG. 3C shows the generalized form for computing the entire vector F[ ]. Expressed in pseudo code format, it can be seen that the operation 302 computes the first four elements of F[ ]. The operation 304 computes the remaining elements of F[ ], four elements at a time. The term SubFormSz refers to the number of samples in a subframe.

In accordance with various implementations of the embodiments of the present invention these operations are implemented in a computer processing architecture that supports a SIMD instruction set. A commonly provided instruction is the "multiply and accumulate" (MAC) instruction, which performs the operation of multiplying two operands and summing the product to a third operand. A generic MAC instruction might be:

MAC %1 %2 %3 , %3←%3+(%1×%2)

where %1, %2, and %3 are the register operands.

In a SIMD architecture, the MAC instruction performs the operation simultaneously on multiple sets of data. Typically, the registers used by a SIMD machine can store multiple data. For example, a 64-bit register (e.g., %1) can contain four 16-bit data (e.g., $\%1_0$, $\%1_1$, $\%1_2$, and $\%1_3$) to provide what will be referred to as "4-way parallel" SIMD architecture. Thus, execution of the foregoing MAC instruction would perform the following operations in a 4-way SIMD machine:

$$\%3_0\leftarrow\%3_0+(\%1_0\times\%2_0)$$

$$\%3_1\leftarrow\%3_1+(\%1_1\times\%2_1)$$

$$\%3_2 \leftarrow \%3_2+(\%1_2 \times \%2_2)$$

$$\%3_3 \leftarrow \%3_3+(\%1_3 \times \%2_3)$$

Typically, a SIMD instruction set comprises a full complement of instructions for all math and logical operations, and for memory load and store operations. Specific instruction formats will vary from one manufacturer of processing unit to another. However, the same ideas of parallel operations are common among them.

Figure 4A:
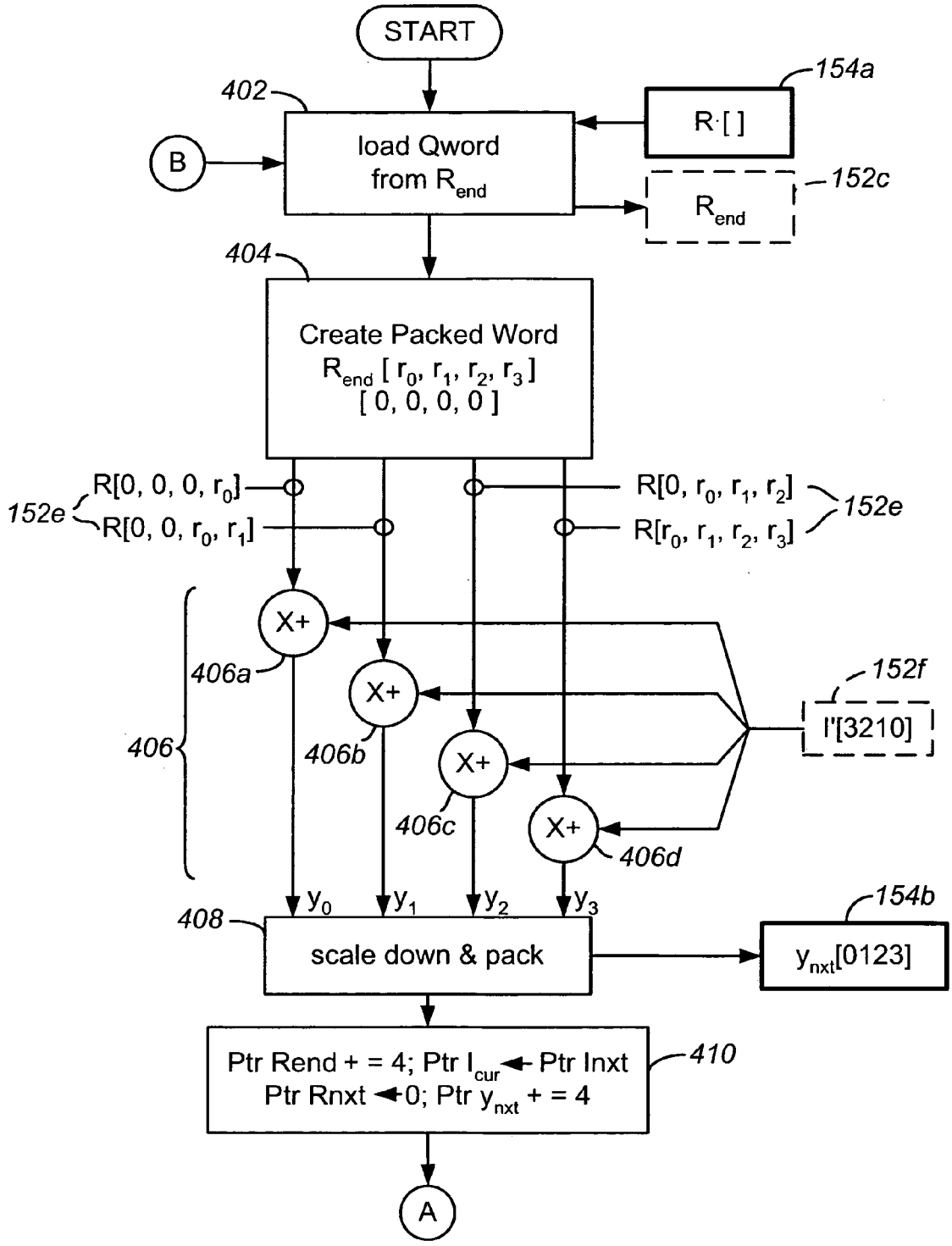
FIGS. 4A and 4B illustrate a high level discussion of a flow chart for performing the matrix operations shown in FIG. 3C.
Figure 4B:
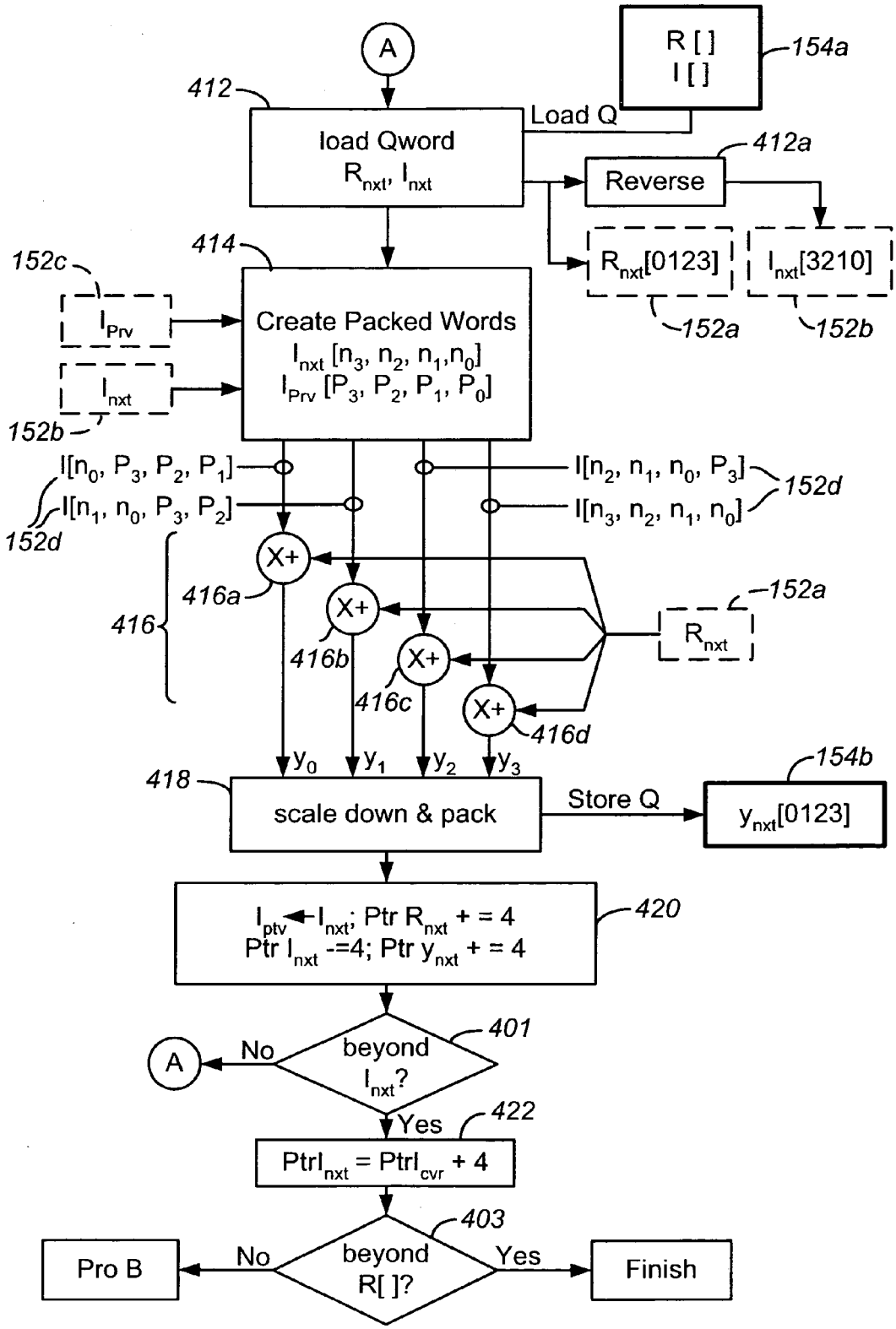

FIGS. 4A and 4B show the process flow for performing the operations shown in FIG. 3C. The SH5 SIMD instruction is used merely to provide a context for explaining the figures. The SH5 instruction set supports 4-way parallel instructions. In this particular implementation in accordance with an embodiment of the invention, vector elements (R[ ], I[ ], and F[ ]) are word-sized 16-bit data. It can be appreciated of course that other word sizes are possible. The registers are 64 bits wide. For the following discussion of FIGS. 4A and 4B, the vector F[ ] is represented by output vector Ynxt[ ].

The processing in FIG. 4A includes a step 402 of loading a quad word from memory area 154*a* in the memory component (FIG. 1A) from the vector R[ ] (pointed to by ptrRend, initially set to point to the beginning of the vector R[ ]). Each quad word represents four elements of a vector. Thus, four elements (quad-word) from the vector R[ ] are loaded into a (64-bit) register $R_{end}$ 152*c*, and are identified generically as (r0, r1, r2, r3) without reference to any specific four elements.

In a step 404, the quad words contained in the register $R_{end}$ are copied to an intermediate register 152*e* to produce the following intermediate quad words: (0, 0, 0, r0), (0, 0, r0, r1), (0, r0, r1, r2), and (r0, r1, r2, r3). Each intermediate quad word is combined in a MAC (multiply and accumulate) operation with another intermediate register 152*f* which contains the first four words (I1, I2, I3, I4) from the impulse response vector I[ ]. Thus, in a MAC operation (step 406*a*), the output for y0 is computed:

$$y0=0\times I_3+0\times I_2 3+0\times I_1+r0\times I_0.$$

Similarly in subsequent MAC operations (steps 406*b*–406*d*), the following are computed:

$$y1=0\times I_3+0\times I_2 3+r0\times I_1+r1\times I_0,$$

$$y2=0\times I_3+r0\times I_2 3+r1\times I_1+r2\times I_0,$$

$$y3=r0\times I_3+r1\times I_2 3+r2\times I_1+r3\times I_0.$$

The outputs of the MAC operations are stored in registers used by the SIMD engine 152 (FIG. 1A).

In a step 408, the contents of the registers containing the outputs y0–y3 are written to the output vector Ynxt[ ] in a memory area 154*b* in the memory component 154, pointed to by a pointer ptrYnxt which initially points to the beginning of the vector.

Next, various pointers are updated in a step 410 in preparation for the subsequent operations. The pointer ptrRend is incremented by four. A pointer ptrInxt is copied to ptrIcur. A pointer ptrRnxt is set to the beginning of R[ ]. The ptrYnxt is incremented by four.

Note that by setting the pointers ptrRend to the beginning of the vector R[ ] and ptrYnxt to the beginning of vector Ynxt[ ], the very first iteration through the foregoing steps produces the boundary condition computation shown in FIG. 3C as operation 302. After the update step 410, the pointers are properly adjusted for to perform the operation 304, the processing of which is shown in FIG. 4B. As can be appreciated, subsequent iterations through the foregoing steps produce the boundary condition computation identified as 304*a* in FIG. 3C.

The processing in FIG. 4B includes a step 412 of loading a quad word from areas 154*a* in the memory component 154 (FIG. 1A) that store the vectors R[ ] and I[ ]. Thus, four elements from the vector R[ ] beginning at a location pointed to by a pointer ptrRnxt are loaded into a register $R_{nxt}$ 152*a*, and are identified generically as (r0, r1, r2, r3). Four elements from the impulse response vector I[ ] in memory area 154*a*, beginning at a location pointed to by a pointer ptrInxt, are similarly loaded into another register $T_{nxt}$ 152*b*. However, an operation to reverse the order of the four elements from I[ ] is first performed in a step 412*a* to store the data referred to generically as (n3, n2, n1, n0).

Next, in a step 414, the data (n3, n2, n1, n0) in the $I_{nxt}$ register 152*b* and the data (p3, p2, p1, p0) in another register $I_{prv}$ 152*c* are manipulated to produce combinations of quad words stored in an intermediate register 152*d*, in preparation for a set of MAC operations (step 416). Thus, in a step 416*a*, a MAC operation between the $R_{nxt}$ register 152*a* and the intermediate register 152*d* containing the packed quad-word (n0, p3, p2, p1) produces the output y0 defined as:

$$y0=r0\times n0+r1\times p3+r2\times p2+r3\times p3$$

Similar operations are performed in steps 416*b*–416*d*, to produce outputs y1–y3 respectively. The outputs y0–y3 are also registers used by the SIMD engine 152 (FIG. 1A). In a step 418, the outputs are written to the vector Ynxt[ ].

Registers are updated in a step 420 in preparation to continue the inner sum operation. Thus, the contents of the $I_{nxt}$ register are copied to the $I_{prv}$ register because in the next iteration the current contents of $I_{nxt}$ become the "previous" contents. Various pointers to the vectors in the memory 154 are updated. A pointer ptrRnxt is incremented by 4, as is the pointer ptrYnxt. A pointer ptrInxt is decremented by four.

A test is performed in a step 401 to determine if the lower limit of the impulse vector I[ ] is exceeded. Step 401 checks the pointer ptrInxt is decremented beyond this lower limit. The lower limit is defined in the generalized inner sum operation 304*b* (FIG. 3C) for the index m. If the lower limit is not exceeded, then the operation repeats with step 412, as indicated by the connector A. If the lower limit is exceeded, then the inner sum operation is complete. A pointer ptrRend (see FIG. 4B) is checked to determine if the end of the vector R[ ] is reached. If not, then the operation repeats with step 402 on FIG. 4A, as indicated by the connector B.

Referring to FIGS. 3A & 3B and 4A & 4B, it can be appreciated that the matrix operations according to the invention allow for a reduction of memory access requirements, thus saving on valuable CPU cycles. The operations provide for reuse of data already retrieved for other operations. The shaded areas 312*a*–312*c* shown in FIGS. 3A and 3B (see also 212*a*–212*d* in FIGS. 2A–2C) represent data previously retrieved from memory 154. Thus, the matrix operation shown in FIG. 3A involves a memory fetch of the four words for $R_n$–$R_{n+3}$, shown in the unshaded area. The SIMD MAC operation can then be applied to perform the indicated matrix operation. Note from FIG. 4A that the first four elements of the impulse vector I[ ] are always used, so they will have been pre-load into a register at the very beginning of the matrix operations.

Similarly, the matrix operation shown in FIG. 3B lends itself to reusing pre-fetched data in a SIMD architecture. The vector I[ ] elements $I_{m-6}$–$I_{m-3}$, are stored as previously fetched elements so that the inner sum of products operation requires only one fetch operation from memory 154 to retrieve the quad words constituting elements $I_{m-3}$–$I_m$.

The following assembly code fragment is provided merely to illustrate an example of an implementation of the processing shown in FIGS. 4A and 4B. The example code is based on the SH5 instruction set. Various portions of the code are shown in bold text, underlined text, and italicized text to highlight the various operations shown in FIGS. 4A and 4B. The code highlighted in bold text, perform the steps 402 to 410 corresponding to the matrix operation 302 in FIG. C. The code highlighted by the underlined text perform the steps 402 to 410 and steps 422 and 403 corresponding to outer loop operation 304*a* of the matrix operation 304 (the outer loop). The code highlighted by the italicized text perform the steps 412 to decision step 401 corresponding to the inner loop operation 304*b* of the matrix operation 304.

Example of Assembly Code for the SH5 Architecture

```
__obj__copy(x): copy content of x in to a register, do not modify x
__reg__int(): allocate a register
__label(): define a label, used as a jump target
__obj__memory(): indicate that memory has been modifed.
__code(
        "LT__PT         %16,TR6         ; Load Target branch Reg 6"
        "LT__PT         %17,TR7         ; Load Target branch Reg 7"
        "MOVI           #27,%4          ; create control constant 0x1b in R27"
                                        "; for byte manipulation using permute instruction"
        "LD.Q           %2,#0,%3        ; Load 4 words of the impulse response ImpResp]0,1,2,3]"
        "MOVI           #16384,%18      ; Constant 0x4000 - value for rounding"
        "LD.Q           %0,#0,%1        ; Load the residual excitation buffer RezBuf[0,1,2,3]"
        "MPERM.W        %3,%4,%3        ; Reverse permute I[3 2 1 0]"
        "ADD            %18,R63,%6      ; Move 0x4000 into accumulator (Reg 6)"
        "MEXTR2         R63,%1,%5       ; Extract the first word [0 0 0 R0]"
        "MMULSUM.WQ     %3,%5,%6        ; (MAC) y0(%6) += [0 0 0 R0]*I[3 2 1 0]"
        "ADD            %18,R63,%10     ; Move 0x4000 into second accumulator (Reg 10)"
        "MEXTR4         R63,%1,%5       ; Extract 2 words [0 0 R0 R1]"
        "MMULSUM.WQ     %3,%5,%10       ; (MAC) y1 += [0 0 R0 R1]*I[3 2 1 0]"
        "ADD            %18,R63,%11     ; Move 0x4000 into third accumulator"
        "MEXTR6         R63,%1,%5       ; Extract 3 words [0 R0 1 2]"
        "MMULSUM.WQ     %3,%5,%11       ; (MAC) y2 += [0 R0 1 2]*[3 2 1 0]"
        "ADD            %18,R63,%12     ; Move 0x4000 into thrid accumulator"
        "MMULSUM.WQ     %3,%1,%12       ; (mAC) y3 += [R0 1 2 3]*[3 2 1 0]"
";Combine the results into 32 bit packed format."
        "MSHFLO.L       %6,%10,%10      ; y[0,1]"
        "MOVI           #15,%19         ; Right shift value"
        "MSHARD.L       %10,%19,%10     ; scale down by 16"
        "MSHFLO.L       %11,%12,%12     ; y[2,3]"
        "MSHARD.L       %12,%19,%12     ;"
        "MCNVS.LW       %10,%12,%12     ; Combine the above accumulators into y[0 1 2 3]"
        "ADD            %3,R63,%9       ; copy [I3 2 1 0]
        "ADD            %0,R63,%13      ; copy of R start address"
        "ST.Q           %7,#0,%12       ; Store y[] (y7)"
        "ADDI           %0,#112,%15     ; Get the address of R[56 57 56 55]"
        "ADDI           %2,#8,%2        ; point to I[4 5 6 7]"
        "%16:                           ; loop point"
        "ADDI           %0,#8,%0        ; point to next R (R[4 5 6 7])"
        "LD.Q           %0,#0,%1        ; Load next quad (R[4 5 6 7])"
        "ADDI           %7,#8,%7        ; point to next y"
";Initialize accumulators"
        "ADD            %18,R63,%6      ; Move 0x4000 into yx"
        "ADD            %18,R63,%10     ;"
        "ADD            %18,R63,%11     ;"
        "ADD            %18,R63,%12     ;"
";Computation for the end of the series for 4 output"
        "MEXTR2         R63,%1,%5       ; Extract End R ([0 0 0 R4])"
        "MMULSUM.WQ     %9,%5,%6        ; y (y4) = End R ([0 0 0 R4]) * Start I ([3 2 1 0])"
        "MEXTR4         R63,%1,%5       ; Extract End R [0 0 R4 5]"
        "MMULSUM.WQ     %9,%5,%10       ; y+1 (y5) = End R ([0 0 R4 5])*Start I ([3 2 1 0])"
        "MEXTR6         R63,%1,%5       ; Extract End R [0 R4 5 6]"
        "MMULSUM.WQ     %9,%5,%11       ; y+2 (y6) = End R ([0 R4 5 6])*Start I ([3 2 1 0])"
        "MMULSUM.WQ     %9,%1,%12       ; y+3 (y7) = End R ([R4 5 6 7])*Start I ([3 2 1 0])"
        "ADD            %13,R63,%14     ; %14 current 'R' Address"
        "ADD            %2,R63,%1       ; %1: Tmp end addr of I"
        "%17;                           ;"
"Computation of Quad mul-sums for the 4 outputs"
        "LD.Q           %2,#0,%3        ; Load new I (I[4 5 6 7])"
        "LD.Q           %2,#-8,%9       ; Load new-1 I (I[4 5 6 7])"
        "LD.Q           %14,#0,%8       ; Load next R (R[0 1 2 3])"
        "MPERM.W        %3,%4,%3        ; Reverse permute (I[7 6 5 4])"
        "MPERM.W        %9,%4,%9        ; Reverse permute (I[7 6 5 4])"
        "; %9: Last I Q word loaded ([3 2 1 0])"
```

-continued

```
        "; %8: Lasr R Q word loaded ([0 1 2 3])"
        "MEXTR6          %3,%9,%5        ; Extract I LSH 1([4 3 2 1])"
        "MMULSUM.WQ      %8,%5,%6        ; y (y4) += [R0 1 2 3]*[4 3 2 1]"
        "MEXTR4          %3,%9,%5        ; Extract I LSH 2([5 4 3 2])"
        "MMULSUM.WQ      %8,%5,%10       ; Y (Y5) += [R0 1 2 3]*[5 4 3 2]"
        "MEXTR2          %3,%9,%5        ; Extract I LSH 3([5 6 4 3])"
        "MMULSUM.WQ      %8,%5,%11       ; Y (Y6) += [R0 1 2 3]*[6 5 4 3]"
        "MMULSUM.WQ      %8,%3,%12       ; y (y7) += [R0 1 2 3]*[7 6 5 4]"
        "ADDI            %14,#8,%14      ; Incr R ptr"
        "ADDI            %2,#-8,%2       ; Decr I ptr"
        "BNE             %14,%0,TR7      ; Loop to compute all quad mults"
";Combine the results into 32 bit packed format."
        "MSHFLO.L        %6,%10,%10      ; y[0,1]"
        "MSHFLO.L        %11,%12,%12     ; y[2,3]"
";scale down by 16"
        "MSHARD.L        %10,%19,%10     ;"
        "MSHARD.L        %12,%19,%12     ;"
        "MCNVS.LW        %10,%12,%12     ; y[0 1 2 3]"
        "ADDI            %1,#8,%2        ; Restore I ptr to next higher quad entry"
        "ST.Q            %7,#0,%12       ; Store y (y7)"
        "BNE             %14,%15,TR6     ; Loop for all set of 4 outputs"
        .__obj__copy(RezBuf+4),__reg__int(),__obj__copy(ImpResp),__reg__int(),__reg__int()
        ,__reg__int(),__reg__int(),__obj__copy(FltBuf[4]),__reg__int(),__reg__int()
        ,__reg__int(),__reg__int(),__reg__int(),__reg__int(),__reg13 int(),__reg__int()
        ,__label(),__label(),__reg__int(),__reg13 int(),__obj__memory());
```

FIG. 5A shows a generalized form of the matrix operations shown in FIGS. 2A–2C. Though the matrix operations in FIGS. 2A–2C are for a 4×4 matrix configuration, it can be appreciated that these operations can scale to larger matrix configurations; for example, a set of 8×8 matrix operations can be formulated. The subscripts used in the matrix operations shown in FIG. 5A are based on $2^s$, where s is a positive integer greater than one. It can be seen that the operations in FIGS. 2A–2C are defined by the operations shown in FIG. 5A for s=2.

FIG. 5B shows a further generalization of operations 504 and 506 shown in FIG. 2A to produce a generalized form of the operation 304 shown in FIG. 3C for computing the inner sum of products term. Here, the index n is incremented by $2^s$, and the index m is a decremented by $2^s$.

It can be seen that the generalized form shown in FIG. 5B is suitable for $2^s$-way parallel SIMD architectures. For example, where s=3, an 8-way SIMD machine can be used to implement the matrix operations. It is noted however, that an 8-way SIMD instruction set can be used to implement the 4×4 matrix operations shown in FIG. 3C. In such an implementation, each MAC operation can be performed on two sets of quad words.

Conversely, if a SIMD architecture provides for 2-way parallelism, it can be appreciated that the matrix operations are nonetheless suited for 2-way parallel operations, albeit requiring two operations to perform. For example, operations using a 4×4 matrix (i.e., FIG. 3C) would require two MAC instructions per vector multiplication of each row of the matrix. Thus, where the product:

$$\begin{bmatrix} 0 & 0 & 0 & R_0 \\ 0 & 0 & R_0 & R_1 \\ 0 & R_0 & R_1 & R_2 \\ R_0 & R_1 & R_2 & R_3 \end{bmatrix} \times \begin{bmatrix} I_3 \\ I_2 \\ I_1 \\ I_0 \end{bmatrix}$$

would require four MAC operations to compute on 4-way SIMD engine, the same product would require eight MAC operations to compute on a 2-way SIMD machine.

It is further noted that word size can determine the amount of parallelism attainable. Consider a 4-way SIMD, using 64-bit registers. A 16-bit data size results in a single MAC instruction per vector multiplication of a row in the matrix. However, an 8-bit data size would allow for two such multiplication operations to occur per MAC instruction. Conversely, a 32-bit data size would require two MAC instructions per matrix row.

It can be appreciated from the foregoing that varying degrees of parallelism and hence attainable performance gains can be achieved by a proper selection of SIMD parallelism and word size. The selection involves tradeoffs of available technology, system cost, performance goals such as speed, quality of synthesized speech, and the like. While such considerations may be particularly relevant to the specific implementation of the present invention, they are not germane to the invention itself.

The foregoing description of the present invention was presented using human speech as the source of analog signal being processed. It noted this is merely for convenience of explanation. It can be appreciated that any form of analog signal of bandwidth within the sampling capability of the system can be subject to the processing disclosed herein, and that the term "speech" can therefore be expanded to refer any such analog signals.

It can be further appreciated that the specific arrangement which has been described is merely illustrative of one implementation of an embodiment according to the principles of the invention. Numerous modifications may be made by those skilled in the art without departing from the true spirit and scope of the invention as set forth in the following claims.

What is claimed is:

1. In a computer device for speech synthesis, a method for searching a codebook of excitation vectors to identify a selected excitation vector for CELP (code-excited linear prediction) coding comprising:

receiving an input speech signal;

computing a metric $M_i$ based on the input speech signal and a signal synthesized by an excitation vector $v_i$;

repeating the computing step for each excitation vector in the codebook; and identifying a minimum metric ($M_{min}$) from among the computed $M_i$'s, the excitation vector associated with $M_{min}$ being the selected excitation vector used to produce synthesized speech, wherein the computing step includes computing a correlation quantity between a target vector signal and an impulse response comprising:

accessing elements $R_i$ of a first vector (R) stored in a first area of a memory component of the computer device and representative of the target vector signal;

accessing elements $I_i$ of a second vector (I) stored in a second area of the memory component and representative of the impulse response;

7. The method of claim 1 wherein the computing steps are performed by a central processing unit having a $2^t$-way SIMD (single instruction multiple data) instruction set, where t≠s.

8. The method of claim 1 wherein the step of computing the vector F2 includes loading the elements $I_{(m-(2^s-1))}$ through $I_m$ from the vector I into a first set of one or more registers in a central processing unit (CPU) of the computing device, wherein the elements $I_{(m-(2^s-1))-(2^s-1)}$ through $I_{(m-(2^s-1))+1}$ from the vector I will have been previously loaded into a second set of one or more registers in the CPU.

9. A computer program product suitable for execution on a data processing device for use in a speech synthesis system, the data processing device supporting SIMD (single instruction multiple data) instructions comprising:

$$\text{computing a vector } F1 = \begin{bmatrix} 0 & \cdots & \cdots & 0 & R_0 \\ \vdots & & & R_0 & R_1 \\ \vdots & & \iddots & & \vdots \\ 0 & R_0 & & & \vdots \\ R_0 & R_1 & \cdots & \cdots & R_{(2^s-1)} \end{bmatrix} \times \begin{bmatrix} I_{2^s-1} \\ \vdots \\ \vdots \\ \vdots \\ I_0 \end{bmatrix}; \text{ and}$$

$$\text{computing a vector } F2 = \sum_{n=2^s}^{Frm,step\,4} \left\{ \begin{bmatrix} 0 & \cdots & \cdots & 0 & R_n \\ \vdots & & & R_n & R_{n+1} \\ \vdots & & \iddots & & \vdots \\ 0 & R_n & & & \vdots \\ R_n & R_{n+1} & \cdots & \cdots & R_{n+(2^s-1)} \end{bmatrix} \times \begin{bmatrix} I_{2^s-1} \\ \vdots \\ \vdots \\ \vdots \\ I_0 \end{bmatrix} + \sum_{\substack{m=n+(2^s-1) \\ l=0}}^{\substack{m-2\times(2^s-1)>0 \\ m,step\,-4 \\ l,step\,4}} \begin{bmatrix} I_{(m-(2^s-1))-(2^s-1)} & \cdots & I_{(m-(2^s-1))} \\ \vdots & & \vdots \\ \vdots & & \vdots \\ I_{(m-(2^s-1))} & \cdots & I_m \end{bmatrix} \times \begin{bmatrix} R_{l+(2^s-1)} \\ \vdots \\ \vdots \\ R_l \end{bmatrix} \right\},$$

where s>1 and Frm is a framesize, wherein the vectors F1 and F2 together are representative of the correlation quantity.

2. The method of claim 1 wherein the metric $M_i$ is defined by $$\left(\frac{(dv_i)^2}{v_i^T \phi v_i}\right),$$

where d is the correlation quantity and

ϕ is a covariance matrix of the impulse response.

3. The method of claim 1 wherein s=2.

4. The method of claim 1 wherein the computing steps are performed by a central processing unit having a $2^s$-way SIMD (single instruction multiple data) instruction set.

5. The method of claim 1 wherein the computing steps are performed by a central processing unit having a $2^{s+1}$-way SIMD (single instruction multiple data) instruction set.

6. The method of claim 5 wherein the SIMD instruction set includes a multiply and accumulate (MAC) instruction, each of the matrix products [ . . . ]×[ . . . ] includes executing $2^{s-1}$ MAC instructions.

computer readable media containing a computer program to select an excitation vector from codebook containing a plurality of excitation vectors v, the computer program comprising:

first computer program code to operate the data processing device to access from a first area of a memory component elements $R_i$ of a vector R representative of a target vector signal;

second computer program code to operate the data processing device to access from a second area of the computer memory component elements $I_i$ of a vector I representative of an impulse response;

third computer program code to operate the data processing device to access the excitation vectors v from the codebook, the codebook stored in a third area of the computer memory component;

fourth computer program code to operate the data processing device to compute a metric $M_i$ based on an input speech signal and a signal synthesized from an excitation vector $v_i$, including computing a vector F2 which is a portion of a correlation vector d representative of a correlation between the target vector signal and the impulse response, where $$\text{vector } F2 = \sum_{n=2^s}^{Frm,step\,4} \left\{ \begin{bmatrix} 0 & \cdots & \cdots & 0 & R_n \\ \vdots & & & R_n & R_{n+1} \\ \vdots & & \iddots & & \vdots \\ 0 & R_n & & & \vdots \\ R_n & R_{n+1} & \cdots & \cdots & R_{n+(2^s-1)} \end{bmatrix} \times \begin{bmatrix} I_{2^s-1} \\ \vdots \\ \vdots \\ \vdots \\ I_0 \end{bmatrix} + \sum_{\substack{m=n+(2^s-1) \\ l=0}}^{\substack{m-2\times(2^s-1)>0 \\ m,step\,-4 \\ l,step\,4}} \begin{bmatrix} I_{(m-(2^s-1))-(2^s-1)} & \cdots & I_{(m-(2^s-1))} \\ \vdots & & \vdots \\ \vdots & & \vdots \\ I_{(m-(2^s-1))} & \cdots & I_m \end{bmatrix} \times \begin{bmatrix} R_{l+(2^s-1)} \\ \vdots \\ \vdots \\ R_l \end{bmatrix} \right\},$$

s>1 and Frm is a framesize;

fifth computer program code to obtain the input speech signal; and sixth computer program code to coordinate the first, second, third and fourth computer program codes to compute a metric for each excitation vector in the codebook and to identify a minimum metric therefrom, the excitation vector associated with the minimum metric being the selected excitation vector, wherein the selected excitation vector can be used to synthesize speech.

10. The computer program product of claim 9 wherein the metric $M_i$ is defined by $$\left(\frac{(dv_i)^2}{v_i^T \phi v_i}\right),$$

where $\phi$ is a covariance matrix of the impulse response.

11. The computer program product of claim 9 further including additional computer program code to operate the data processing device to compute a vector F1, where $$\text{vector } F1 = \begin{bmatrix} 0 & \cdots & \cdots & 0 & R_0 \\ \vdots & & & R_0 & R_1 \\ \vdots & & \iddots & & \vdots \\ 0 & R_0 & & & \vdots \\ R_0 & R_1 & \cdots & \cdots & R_{(2^s-1)} \end{bmatrix} \times \begin{bmatrix} I_{2^s-1} \\ \vdots \\ \vdots \\ \vdots \\ I_0 \end{bmatrix},$$

wherein the vector F1 and the vector F2 together constitute the correlation vector d.

12. The computer program product of claim 9 wherein s=2 and the SIMD instructions include a 4-way multiply and accumulate (MAC) instruction and each of the two matrix products [ . . . ]×[ . . . ] includes executing four MAC instructions.

13. The computer program product of claim 9 wherein s=2 and the SIMD instructions include an 8-way multiply and accumulate (MAC) instruction and each of the two matrix product operations [ . . . ]×[ . . . ] includes executing two MAC instructions.

14. A speech codec device comprising:

a input component operable to receive a speech signal to produce an input speech signal;

a processing component supporting one or more single instruction multiple data (SIMD) instructions;

a data storage component coupled to the processing component for transferring data therebetween;

a first portion of the data storage component having stored therein a codebook of excitation vectors v;

a second portion of the data storage component having stored therein a vector R representative of a target vector signal generated based on the input speech signal;

a third portion of the data storage component having stored therein a vector I representative of an impulse response to a synthesis filter; and computer program code stored in the data storage component comprising a code portion suitable for execution on the processing component to compute a metric $M_i$=

$$\left(\frac{(dv_i)^2}{v_i^T \phi v_i}\right)$$

for an excitation vector $v_i$, where $\phi$ is a covariance matrix of the impulse response and d is a correlation vector representative of a correlation between the target vector signal and the impulse response, the correlation vector d comprising a vector F1 and a vector F2, wherein $$\text{vector } F1 = \begin{bmatrix} 0 & \cdots & \cdots & 0 & R_0 \\ \vdots & & & R_0 & R_1 \\ \vdots & & \iddots & & \vdots \\ 0 & R_0 & & & \vdots \\ R_0 & R_1 & \cdots & \cdots & R_{(2^s-1)} \end{bmatrix} \times \begin{bmatrix} I_{2^s-1} \\ \vdots \\ \vdots \\ \vdots \\ I_0 \end{bmatrix} \text{ and}$$

$$\text{vector } F2 = \sum_{n=2^s}^{Frm,step\,4} \left\{ \begin{bmatrix} 0 & \cdots & \cdots & 0 & R_n \\ \vdots & & & R_n & R_{n+1} \\ \vdots & & \iddots & & \vdots \\ 0 & R_n & & & \vdots \\ R_n & R_{n+1} & \cdots & \cdots & R_{n+(2^s-1)} \end{bmatrix} \times \begin{bmatrix} I_{2^s-1} \\ \vdots \\ \vdots \\ \vdots \\ I_0 \end{bmatrix} + \sum_{\substack{m=n+(2^s-1) \\ l=0}}^{\substack{m-2\times(2^s-1)>0 \\ m,step-4 \\ i,step\,4}} \begin{bmatrix} I_{(m-(2^s-1))-(2^s-1)} & \cdots & I_{(m-(2^s-1))} \\ \vdots & & \vdots \\ \vdots & & \vdots \\ I_{(m-(2^s-1))} & \cdots & I_m \end{bmatrix} \times \begin{bmatrix} R_{l+(2^s-1)} \\ \vdots \\ \vdots \\ R_l \end{bmatrix} \right\},$$

where s>1 and Frm is a framesize, the computer program code further computing a plurality of the metrics $M_i$ and identifying a minimum one of the metrics $M_{min}$, wherein the excitation vector corresponding to $M_{min}$ constitutes a selected excitation vector.

15. The device of claim 14 wherein the one or more SIMD instructions provide N-way parallelism, wherein N and $2^s$ are related by a power of 2.

16. The device of claim 14 wherein s=2.

17. The device of claim 14 wherein the one or more SIMD instructions provide 4-way parallelism and s=2.

18. The device of claim 14 wherein the one or more SIMD instructions provide 8-way parallelism and s=2, and wherein each of the three matrix products [ . . . ]×[ . . . ] includes executing two multiply and accumulate instructions.

19. A speech synthesis device comprising:

means for receiving input speech to produce an input speech signal;

data processing means for performing single instruction multiple data (SIMD) operations, including a multiply and accumulate (MAC) operation;

memory means, in data communication with the data processing means, for storing a vector R representative of a target vector signal produced based on the input speech signal, a vector I representative of an impulse response to a synthesis filter, and a codebook of excitation vectors v; and computer program code stored in the memory means comprising a code segment suitable for execution on the data processing means to compute a metric $$M_i = \left(\frac{(dv_i)^2}{v_i^T \phi v_i}\right)$$

for an excitation vector $v_i$, where $\phi$ is a covariance matrix of the impulse response and d is a correlation vector representative of a correlation between the target vector signal and the impulse response, the correlation vector d comprising a vector F1 and a vector F2, wherein $$\text{vector } F1 = \begin{bmatrix} 0 & 0 & 0 & R_0 \\ 0 & 0 & R_0 & R_1 \\ 0 & R_0 & R_1 & R_2 \\ R_0 & R_1 & R_2 & R_3 \end{bmatrix} \times \begin{bmatrix} I_3 \\ I_2 \\ I_1 \\ I_0 \end{bmatrix} \text{ and}$$

$$\text{vector } F2 = \sum_{n=4}^{Frm,step\,4} \left\{ \begin{bmatrix} 0 & 0 & 0 & R_n \\ 0 & 0 & R_n & R_{n+1} \\ 0 & R_n & R_{n+1} & R_{n+2} \\ R_n & R_{n+1} & R_{n+2} & R_{n+3} \end{bmatrix} \times \begin{bmatrix} I_3 \\ I_2 \\ I_1 \\ I_0 \end{bmatrix} + \sum_{\substack{m=n+(2^S-1) \\ l=0}}^{\substack{m-6>0 \\ m,step-4 \\ l,step\,4}} \begin{bmatrix} I_{m-6} & I_{m-5} & I_{m-4} & I_{m-3} \\ I_{m-5} & I_{m-4} & I_{m-3} & I_{m-2} \\ I_{m-4} & I_{m-3} & I_{m-2} & I_{m-1} \\ I_{m-3} & I_{m-2} & I_{m-1} & I_m \end{bmatrix} \times \begin{bmatrix} R_{l+3} \\ R_{l+2} \\ R_{l+1} \\ R_l \end{bmatrix} \right\},$$

where Frm is a framesize.

20. The speech synthesis device of claim 19 wherein the MAC instruction is an 8-way parallel instruction and each of the three matrix product operations [ . . . ]×[ . . . ] includes executing two MAC instructions.

21. The speech synthesis device of claim 19 wherein the MAC instruction is a 4-way parallel instruction.

* * * * *